United States Patent [19]

Yamamura et al.

[11] 4,339,246

[45] Jul. 13, 1982

[54] MIXED FUEL COMPOSITION

[75] Inventors: Masaaki Yamamura, Wakayama; Taizo Igarashi, Amagasaki; Toshiyuki Ukigai, Chiba, all of Japan

[73] Assignees: Kao Soap Co., Ltd.; Lion Corporation; Nippon Oil Company, Limited; Fats Co., Ltd., all of Tokyo, Japan

[21] Appl. No.: 278,295

[22] Filed: Jun. 26, 1981

[30] Foreign Application Priority Data

Jul. 10, 1980 [JP] Japan ..... 55-94413

[51] Int. Cl.[3] ..... C10L 1/32

[52] U.S. Cl. ..... 44/51; 44/62; 44/70; 44/77; 44/71; 44/72

[58] Field of Search ..... 44/51, 62, 70, 77, 71, 44/72

[56] References Cited

U.S. PATENT DOCUMENTS

| | | | |
|---|---|---|---|
| 3,449,236 | 6/1969 | Engelhart | 44/62 |
| 3,909,215 | 9/1975 | Kray | 44/62 |
| 4,163,645 | 8/1979 | Cheng | 44/62 |
| 4,252,540 | 2/1981 | Yamamura et al. | 44/51 |

*Primary Examiner*—Winston A. Douglas
*Assistant Examiner*—Y. Harris-Smith
*Attorney, Agent, or Firm*—Blanchard, Flynn, Thiel, Boutell & Tanis

[57] ABSTRACT

A mixed fuel composition comprises (a) a fuel oil, (b) a coal powder having an [H]/[C] ratio according to the coalification band method in the range of 0.4–0.75 and an [O]/[C] ratio in the range of 0.09–0.18 and (c) a partially amidated copolymer obtained by reacting a copolymer of a polymerizable, unsaturated hydrocarbon and maleic anhydride with an aliphatic amine of 2–36 carbon-atoms or a salt thereof as a stabilizer.

4 Claims, No Drawings

MIXED FUEL COMPOSITION

The present invention relates to a stable, mixed fuel composition comprising coal powder and a fuel oil. More particularly, the present invention relates to a mixed fuel composition prepared by dispersing fine particles of a specific coal in a fuel oil using a specific dispersion stabilizer.

Investigations on mixed fuels comprising coal and a fuel oil such as heavy oil or crude oil were made for warlike purposes or other purposes during the First World War and the Second World War. However, the practical utilization of those investigations were discontinued after stable petroleum supply had been attained, since those investigations were made mainly for making up for a deficiency of petroleum supply. Therefore, investigations were made again on coalcontaining liquid fuels on the basis of an idea of reducing handling costs, since the transportation of coal requires many hands for the shipping and discharging or for the conveyance after the discharging. In France and U.S.A., aqueous slurry transportation has been realized in which fine coal particles are transported by the hydraulic transportation through pipelines. Though the discussions were made also in Japan on the hydraulic transportation of aqueous coal slurry, this means was not employed practically, since marine transportation is employed predominantly and costs of the transportation are increased due to water in the aqueous slurry and, in addition, combustion efficiency is reduced unfavorably. There has been reported an idea of using a petroleum fuel in place of water to overcome said defects. Under the circumstances as above, the above mentioned mixed fuel comprising coal and a fuel oil such as heavy oil and crude oil, i.e. COM (Coal/Oil Mixture), is now reconsidered. Currently, the practical utilization of COM is studied for the purpose of reducing costs by using COM in place of the heavy oil the price of which was increased remarkably after the oil shock and also for the purpose of utilizing coal which is an abundant resource. In Japan, coal is imported from foreign countries and, therefore, the reduction in handling costs indicates a reduction in prices of the products. The practical utilization of COM is now eagerly demanded. COM had the following advantages:

(i) COM has a calorific value higher than that of coal. It can be combusted in an existing petroleum combustion device after a partial remodeling.

(ii) The marine transportation of COM by means of a tanker is possible. The transportation of coal on a mass scale is made possible.

(iii) The long distance overland transportation (pipe transportation) is possible.

(iv) The spontaneous ignition of coal during the transportation can be prevented. Therefore, the import of brown coal which could not be imported because of easy spontaneous ignition thereof is made possible.

(v) Area of a storehouse may be small. COM has a specific gravity higher than that of water and, therefore, fire extinguishing is easy even if it catches fire. COM is free of outflow accident unlike crude oil.

(vi) Stable supply of COM is secured. Economical advantage of COM is high.

(vii) COM can be handled like petroleum in the transportation, while in the marine transportation of coal a large recipient harbor quay and a great mechanical equipment investment for the landing and conveyance of the coal are necessitated.

The solid coal particles are sedimented in the fuel oil (dispersion medium) due to a difference in specific gravity between them. The smaller the coal particles, the lower the sedimentation velocity. It is desirable, therefore, to divide the coal into as fine as possible particles. However, on the other hand, pulverization costs are increased as particle size is reduced. Pulvorized coal now used in thermoelectric power plants has such a particle diameter that 80% thereof passes through a 200 mesh sieve, i.e. about 74 microns. Pulverized coal of such a particle size would be employed as a measure of particle size of the powdered coal. If a surfactant is added to COM as a stabilizer, the surfactant is adsorbed on the surface of the coal particle at the interface between the particles and the fuel oil, whereby the coal particles are separated from one another and the coagulation of the particles is prevented. In COM, it is required that the stabilizer (surfactant) promotes the formation of a soft precipitate from the cost particles sedimented in the lower layer. It is required of COM that if it is stirred after the storage for a long period of time, a homogeneous COM is formed again easily. For this purpose, the coal particles should form a soft precipitate which can easily be dispersed again. After the COM preparation, it is passed through many processes such as pipe transportation, tanker transportation and storage in a tank before it is combusted. It is particularly necessary, therefore, that coal particles in COM have a low sedimentation velocity and that they can easily be dispersed again in the dispersion medium. If COM is allowed to stand after the preparation, substantially the whole coal particles are sedimented generally in 1 or 2 days in the absence of the stabilizer, though the period varies depending on the combination of coal and fuel oil. The precipitate thus formed is very hard and redispersibility thereof is quite poor. Therefore, in case COM is to be stored for a long period of time after the preparation, the stabilizer has important roles and excellent stabilizers are thus demanded. The period of the storage of COM in which COM should be stored stably after the preparation thereof is at least 4–7 days, preferably at least 15–30 days, since COM is passed through the above described processes. Further, re-dispersibility after the allowing to stand is demanded.

As to stabilizers for COM, numerous patent applications have been filed by Petrolite Corporation, etc. Though major part of commercially available surfactants is disclosed in those patents, their stabilizing effects are still insufficient. Under the circumstances as above, the development of better stabilizers has eagerly been demanded. The coal particles are sedimented during the storage for a long period of time, since they have relatively large particle diameters as described above. A process for retarding the sedimentation velocity is disclosed in a patent of petrolite Corporation wherein an additive is incorporated therein to increase viscosity thereof, particularly to attain a thixotropic system. However, this process also has defects that a part of the coal particles is sedimented to form a hard precipitate, degree of the thixotropy is limited, the viscosity is increased remarkably to cause practical problems in handling, etc. and the value of COM is seriously degraded.

On the other hand, the stability and re-dispersibility of COM containing the stabilizer vary remarkably depending on the coal used. The coals may be classified by numerous methods. One of the most reasonable methods in due consideration of the stability of COM is coalification band method wherein coals are classified according to a ratio of the quotients obtained by dividing elementary analysis values (wt.%) of each coal by the atomic weights thereof (D. W. van Krevelen et al., "Coal Science" page 98, 1956). Coals having an [H]/[C] of up to 0.75 and an [O]/[C] of up to 0.18 according to this classification method have a considerably high rank of coalification and high oleophilic properties. If a conventional dispersant is used, those coals exhibit excessive oleophilic properties and the coal particles are compacted during the storage to make the re-dispersion difficult.

After intensive investigations made for the purpose of obtaining good COM from the above described coal, the inventors have completed the present invention. The present invention provides a mixed fuel composition of coal powder and a fuel oil characterized by comprising a fuel oil, a coal powder having an [H]/[C] according to coalification band method in the range of 0.4–0.75 and an [O]/[C] in the range of 0.09–0.18 and a partially amidated copolymer obtained by reacting a copolymer of a polymerizable, unsaturated hydrocarbon and maleic anhydride with an aliphatic amine of 2–36 carbon atoms or a salt thereof as stabilizer. [H], [C] and [O] represent the quotients obtained by dividing elementary analysis values (wt.%) of hydrogen, carbon and oxygen, respectively, by the atomic weights thereof.

The coals used in the present invention satisfy the following conditions:

$$0.4 \leqq [H]/[C] \leqq 0.75$$

$$0.09 \leqq [O]/[C] \leqq 0.18$$

Those coals are oleophilic coals of high rank of coalification. Because of the high oleophilic properties thereof, they are apparently in the form of a dispersion. If the stabilizer of the present invention is not used, the bottom part thereof is compacted due to the large particle diameter of the coal particles. Amido group and carboxyl group in the stabilizer of the present invention are adsorbed on the coal particles to form chelates, whereby a loose flocculation structure is formed. As a result, the coal sedimentation is prevented. Even if the coal particles are sedimented, the resulting precipitates can be dispersed again therein by stirring.

As the coals within said range, there may be mentioned bituminous coal such as Witbank coal (South Africa), Blair Athol coal (Australia) and Lithgow coal (Australia). The stabilizer used in the present invention is a partially amidated copolymer obtained by reacting a copolymer of a polymerizable, unsaturated hydrocarbon and maleic anhydride with a saturated or unsaturated aliphatic amine of 2–36 carbon atoms or a salt thereof. As the most preferred partially amidated copolymers or salts thereof used in the present invention, there may be mentioned those which contain units of the following formula (I):

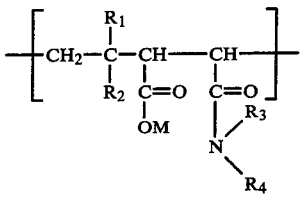

(I)

wherein $R_1$ and $R_2$ each represent hydrogen, an alkyl group or alkenyl group of 1–22 carbon atoms, phenyl group or an alkyl ($C_1$–$C_6$) substituted phenyl group, $R_3$ and $R_4$ each represent H, an alkyl group or an alkenyl group of 8–22 carbon atoms, and M represents H, an alkali metal, an alkaline earth metal or an organic amine. As the organic amines, there may be mentioned methylamine, ethylamine, diethylamine, oleylamine, beef tallow alkylamines, monoethanolamine, diethanolamine, triethanolamine, ethylenediamine and diethylenetriamine. Those compounds having a molecular weight of 1,000–50,000, particularly 1,000–10,000 are preferred for the purpose of the present invention.

As the polymerizable, unsaturated hydrocarbons constituting the copolymers, there may be mentioned aliphatic olefins such as butylene, isobutylene, diisobutylene, 1-octene and 1-dodecene; synthetic olefins of 4–24 carbon atoms; and aromatic olefins such as styrene per se and styrene containing an alkyl group of 1–6 carbon atoms as substituent, for example, dimethylstyrene. Those olefins may be used either alone or in the form of a mixture thereof. As the amine compounds used for the partial amidation, there may be mentioned saturated or unsaturated aliphatic amines of 2–36 carbon atoms. They include primary amines such as octylamine, laurylamine and stearylamine, and secondary amines such as dilaurylamine and distearylamine. The primary amines are preferred to the secondary amines, since the former compounds have a higher reactivity and a higher effect of stabilizing the coal powder. As the aliphatic amines, there may also be used monoethanolamine, diethanolamine and polyoxyethyleneamines. In the amidation of the copolymer, the amine compound is used in an amount of 0.6–1.2 moles per mole of the acid anhydride corresponding to the maleic anhydride moiety in the copolymer. It is most preferred to use one mole of the amine compound to form a semi-amidated compound having one amido group and one carboxyl group from one acid anhydride. As for the amidation rate of the acid anhydride component, a partially amidated product in which at least 60% of the anhydride is semi-amidated may also be used. However, for the purpose of the present invention, an amidated copolymer in which at least 20% of the acid anhydride moiety of the copolymer has been wholly amidated and a completely amidated copolymer are ineffective. Further, no effect can be obtained from hydrolyzates, esterification products or semi-esterification products of the copolymers.

If the stabilizer of the present invention is added to COM in an amount of 0.01–1.0 wt.%, preferably 0.05–0.5 wt.%, the coal particles can be dispersed stably in the fuel oil and the coal particles sedimented form a lower layer of precipitate which can be easily dispersed again. In dispersing fine solid particles in a dispersion medium in the presence of a dispersant, the precipitate formed by the sedimentation and accumulation of the particles during the storage for a long period of time becomes hard as the stabilizing effect is increased. It is required of COM to form a soft precipitate which can easily be dispersed again. The stabilizer of the present invention is characterized in that it forms a soft precipitate which can easily be dispersed again in accordance with the above requirement.

If the mixing ratio of coal (C) to fuel oil (O), i.e. C/O (weight ratio) is extremely low, it becomes insignificant to prepare COM. If C/O is extremely high, the viscosity becomes excessive. C/O (weight ratio) which varies depending on the combination of coal and fuel oil is generally in the range of 20/80–70/30, preferably 40/60–55/45. From the viewpoint of transportation efficiency, water content of COM should be minimized. However, from the viewpoint of stability or re-dispersibility, some water content of COM is recommended. Generally, water content of coals is 1–6 wt.% in many cases. Some coals have a water content of approximately 20–40 wt.%. If the coal has such a high water content, it is preferred to reduce the water content to at most 15% by previous heating or the like. It is more preferred to reduced the water content to several percent or less before it is used for the preparation of COM. When the coal naturally contains about 1–6 wt.% of water, the water may be removed previously or the coal may be used as it is.

As for mixing order of the coal, stabilizer and fuel oil, there may be employed the following methods: The stabilizer is added to the fuel oil to obtain a solution, then the coal is added to the solution and COM is prepared by means of a suitable mixing device or pulverization device. However, COM of a higher stability can be obtained by adding the coal to the fuel oil, preparing COM by means of a suitable mixing device or pulverization device and mixing the same with the stabilizer in a suitable mixing device. Any mixing device or pulverization device may be used if it exhibits a high effect.

The term "fuel oil" herein involves all of liquid fuel oils such as heavy oil and crude oil.

The following examples further illustrate the present invention which by no means limit the present invention.

EXAMPLE 1

COM Preparation:

231.2 g (excluding water contained in the oil) of a Middle East heavy oil*1 was placed in a 500 ml vessel. A given amount of each stabilizer shown in Table 1 was added thereto and the whole was immersed in an oil bath at 70° C. 250 g (excluding water contained in the oil) of Blair Athol coal*2 pulverized into such a particle size that 80% thereof passed through a 200 mesh sieve was added to the above Middle East heavy oil. Since the Middle East heavy oil contained 0.03% of water and the Blair Athol coal contained 7.0% of water, coal (dry)/(Middle East heavy oil+water) was 50/50 (weight ratio). Namely, the sum of water contained in the oil and the coal was 18.9 g. The vessel containing the stabilizer-containing oil and coal was immersed in an oil bath at 70° C. for one hour, whereby the contents of the vessel had the constant temperature. The mixture of the coal and oil maintained at the constant temperature was stirred by means of a laboratory mixer (a product of Tokushu Kikako Co.) at 3000 rpm for 30 minutes to prepare COM, which was then subjected to the stability test.

Stability test:

As a test device, there was used a stainless steel cylinder having an inner diameter of 5.5 cm and a height of 24 cm and having ports each provided with a stopper at positions 6 cm, 12 cm and 18 cm distant from the bottom. Each COM prepared as above was charged in a depth of 18 cm in the cylinder and the whole was allowed to stand in a constant temperature bath at 70° C. for 30 days. After 30 days, the stopper 12 cm distant from the bottom was taken off to take a fraction of COM above this line (i.e. a COM fraction in 12–18 cm zone from the bottom of the cylinder). Coal concentration in thus obtained top layer sample was measured. Then, the stopper 6 cm distant from the bottom was taken off to take out a part of COM positioned above this stopper. Coal concentration in thus obtained middle layer sample was measured. Finally, the remaining COM (bottom layer sample) was taken out and coal concentration thereof was measured. The coal concentrations were determined as follows: 1,1,1-Trichloroethane was added to COM to dissolve the heavy oil fraction therein. The heavy oil fraction was removed by the filtration. The ratio (wt.%) of the amount of coal remaining as the filtration residue to the original amount thereof was determined. The results are shown in Table 2. The smaller the difference in coal concentration in the respective layers, the higher the stability of COM. The results obtained by using coals other than Blair Athol coal are also shown in Table 2.

*1: Middle East heavy oil (produced in the Middle East):

Calorific value: 10310 Kcal/kg (JIS K2265)
Specific Gravity: 0.9576
Pour point: −2.5° C. (JIS K2269)
Flash point: 94.0° C. (JIS K2265)
Ash content: 0.02% (JIS K2272)
Water content: —0.03% (JIS K2275)
Elementary analysis (Yanagimoto Organic automatic element analysis device): C: 84.17%, H: 13.06%, S: 2.39%, H: 0.25%, O: 0.13%, Cl: 3.3 ppm, V: 65 ppm, Na: 15 ppm

*2: Blair Athol coal (produced in Australia):

Gross calorific value: 6720 Kcal/kg (JIS M8814)
Ash content: 7.1% (JIS M8812)
Water content: 7.0% (JIS M8811)
Fixed carbon content: 59.7% (JIS M8812)
Elementary analysis (JIS M8813): C: 82.6%, H: 4.4%, N: 1.9%, O: 11.0%, S: 0.3%,
[H]/[C]=0.63
[O]/[C]=0.10.

TABLE 1

| | | | Amidation | |
|---|---|---|---|---|
| No. | Polymer Composition[1] | $\overline{MW}$ | Amidation agent | Rate[4] |
| Ref. Ex. 1 | 1-Octene/MAn (1/1) | 3000 | n-Octylamine | 1 |
| Ref. Ex. 2 | 1-Octene/MAn (1/1) | 5000 | Stearylamine | 1 |
| Ref. Ex. 3 | 1-Octene/MAn (1/1) | 5000 | " | 0.8 |
| Ref. Ex. 4 | Diisobutylene/MAn (1/1) | 3000 | — | — |
| Ref. Ex. 5 | Diisobutylene/MAn (1/1) | 3000 | Laurylamine | 1 |
| Ref. Ex. 6 | Diisobutylene/MAn (1/1) | 3000 | " | 2 |

TABLE 1-continued

| No. | Polymer Composition[1] | $\overline{MW}$ | Amidation: Amidation agent | Amidation: Rate[4] |
|---|---|---|---|---|
| Ref. Ex. 7 | Diisobutylene/MAn (1/1) | 3000 | Stearylamine | 0.8 |
| Ref. Ex. 8 | Diisobutylene/MAn (1/1) | 5000 | — | — |
| Ref. Ex. 9 | Diisobutylene/MAn (1/1) | 5000 | Stearylamine | 1 |
| Ref. Ex. 10 | Diisobutylene/MAn (1/1) | 5000 | Dilaurylamine | 1 |
| Ref. Ex. 11 | Diisobutylene/MAn (1/1) | 5000 | Oleylamine | 1 |
| Ref. Ex. 12 | Diisobutylene/MAn (1/1) | 5000 | Beef tallow alkylamine | 1 |
| Ref. Ex. 13 | Diisobutylene/MAn (1/1) | 10000 | Stearylamine | 1 |
| Ref. Ex. 14 | 1-Dodecene/MAn (1/1) | 3000 | Laurylamine | 1 |
| Ref. Ex. 15 | α-Olefin 1[2]/MAn (1/1) | 3500 | " | 1 |
| Ref. Ex. 16 | α-Olefin 2[3]/MAn (1/1) | 4000 | " | 1 |
| Ref. Ex. 17 | Styrene/MAn (1/1) | 5000 | — | — |
| Ref. Ex. 18 | Styrene/MAn (1/1) | 5000 | Laurylamine | 1 |
| Ref. Ex. 19 | Styrene/Acrylic acid (1/1) | 6000 | — | — |
| Ref. Ex. 20 | Acrylic acid (1/0) | 5000 | — | — |

[1]MAn: Maleic anhydride
[2]α-Olefin 1: An aliphatic olefin of 13.1 carbon atoms in average having terminal double bond.
[3]α-Olefin 2: An aliphatic olefin of 22.0 carbon atoms in average having terminal double bond.
[4]Amine/acid anhydride (molar ratio)

TABLE 2

| | Coal[2]: Coal | Coal[2]: [H]/[C] | Coal[2]: [O]/[C] | Stabilizer[3] | counter ion | Amount[4] (wt. %) | Stability: top layer | Stability: middle layer | Stability: bottom layer |
|---|---|---|---|---|---|---|---|---|---|
| Examples of the present invention | | | | | | | | | |
| 1 | Witbank | 0.70 | 0.18 | Ref. Ex. 1 | H | 0.2 | 46.2 | 49.7 | 54.1 |
| 2 | " | 0.70 | 0.18 | Ref. Ex. 1 | Na | 0.2 | 45.0 | 50.1 | 54.9 |
| 3 | " | 0.70 | 0.18 | Ref. Ex. 2 | H | 0.2 | 47.6 | 50.2 | 52.8 |
| 4 | " | 0.70 | 0.18 | Ref. Ex. 2 | $NH_4$ | 0.2 | 45.1 | 50.0 | 54.8 |
| 5 | " | 0.70 | 0.18 | Ref. Ex. 5 | H | 0.2 | 47.0 | 50.3 | 52.4 |
| 6 | " | 0.70 | 0.18 | Ref. Ex. 7 | Na | 0.2 | 42.8 | 51.6 | 56.8 |
| 7 | " | 0.70 | 0.18 | Ref. Ex. 9 | H | 0.2 | 47.2 | 50.3 | 52.1 |
| 8 | " | 0.70 | 0.18 | Ref. Ex. 10 | H | 0.2 | 41.4 | 50.9 | 55.7 |
| 9 | " | 0.70 | 0.18 | Ref. Ex. 14 | H | 0.2 | 43.3 | 51.4 | 55.0 |
| 10 | " | 0.70 | 0.18 | Ref. Ex. 15 | Na | 0.2 | 44.5 | 50.7 | 53.5 |
| 11 | " | 0.70 | 0.18 | Ref. Ex. 18 | H | 0.2 | 43.0 | 51.2 | 55.0 |
| 12 | Blair Athol | 0.63 | 0.10 | Ref. Ex. 1 | H | 0.2 | 46.9 | 50.6 | 51.8 |
| 13 | Blair Athol | 0.63 | 0.10 | Ref. Ex. 1 | Na | 0.2 | 45.7 | 51.0 | 52.3 |
| 14 | Blair Athol | 0.63 | 0.10 | Ref. Ex. 2 | H | 0.2 | 47.7 | 50.2 | 50.9 |
| 15 | Blair Athol | 0.63 | 0.10 | Ref. Ex. 2 | $NH_4$ | 0.2 | 46.0 | 50.3 | 52.8 |
| 16 | Blair Athol | 0.63 | 0.10 | Ref. Ex. 3 | H | 0.2 | 43.4 | 50.9 | 55.4 |
| 17 | Blair Athol | 0.63 | 0.10 | Ref. Ex. 5 | H | 0.2 | 46.9 | 50.3 | 52.0 |
| 18 | Blair Athol | 0.63 | 0.10 | Ref. Ex. 7 | H | 0.2 | 45.2 | 51.3 | 53.6 |
| 19 | Blair Athol | 0.63 | 0.10 | Ref. Ex. 7 | Na | 0.2 | 43.0 | 51.3 | 55.7 |
| 20 | Blair Athol | 0.63 | 0.10 | Ref. Ex. 9 | H | 0.2 | 47.0 | 50.3 | 51.3 |
| 21 | Blair Athol | 0.63 | 0.10 | Ref. Ex. 9 | Na | 0.2 | 45.1 | 51.3 | 53.0 |
| 22 | Blair Athol | 0.63 | 0.10 | Ref. Ex. 10 | H | 0.2 | 45.6 | 50.8 | 53.2 |
| 23 | Blair Athol | 0.63 | 0.10 | Ref. Ex. 11 | H | 0.2 | 45.0 | 51.4 | 53.3 |
| 24 | Blair Athol | 0.63 | 0.10 | Ref. Ex. 11 | Na | 0.2 | 43.8 | 51.6 | 53.8 |
| 25 | Blair Athol | 0.63 | 0.10 | Ref. Ex. 12 | H | 0.2 | 44.1 | 51.5 | 53.8 |
| 26 | Blair Athol | 0.63 | 0.10 | Ref. Ex. 13 | H | 0.2 | 47.2 | 50.3 | 51.2 |
| 27 | Blair Athol | 0.63 | 0.10 | Ref. Ex. 13 | Na | 0.2 | 45.0 | 51.2 | 53.0 |
| 28 | Blair Athol | 0.63 | 0.10 | Ref. Ex. 14 | H | 0.2 | 46.7 | 49.9 | 53.0 |
| 29 | Blair Athol | 0.63 | 0.10 | Ref. Ex. 15 | H | 0.2 | 46.0 | 51.0 | 52.8 |
| 30 | Blair Athol | 0.63 | 0.10 | Ref. Ex. 16 | H | 0.2 | 45.7 | 50.6 | 53.8 |
| 31 | Blair Athol | 0.63 | 0.10 | Ref. Ex. 18 | H | 0.2 | 45.4 | 51.1 | 53.0 |
| Comparative Examples[1] | | | | | | | | | |
| 1 | Witbank | 0.70 | 0.18 | Non-addition | — | — | 10.1 | 54.1 | 68.9 |
| 2 | " | 0.70 | 0.18 | Hydrolyzate of Ref. Ex. 4 | Na | 0.2 | 12.0 | 54.0 | 64.4 |
| 3 | " | 0.70 | 0.18 | Ref. Ex. 6 | — | 0.2 | 11.0 | 55.1 | 63.9 |
| 4 | Blair Athol | 0.63 | 0.10 | Non-addition | — | — | 12.4 | 53.7 | 67.8 |
| 5 | Blair Athol | 0.63 | 0.10 | Hydrolyzate of Ref. Ex. 4 | Na | 0.2 | 13.1 | 52.0 | 65.0 |
| 6 | Blair Athol | 0.63 | 0.10 | Butanol semi-ester of Ref. Ex. 5 | H | 0.2 | 12.7 | 54.1 | 65.4 |
| 7 | Blair Athol | 0.63 | 0.10 | Ref. Ex. 6 | — | 0.2 | 12.4 | 54.3 | 64.3 |
| 8 | Blair Athol | 0.63 | 0.10 | Hydrolyzate of Ref. Ex. 17 | Na | 0.2 | 11.9 | 54.5 | 62.0 |
| 9 | Blair Athol | 0.63 | 0.10 | Ref. Ex. 19 | Na | 0.2 | 13.7 | 53.0 | 64.1 |
| 10 | Blair Athol | 0.63 | 0.10 | Ref. Ex. 20 | Na | 0.2 | 14.1 | 53.7 | 63.3 |
| 11 | Warkworth | 0.77 | 0.08 | Ref. Ex. 1 | H | 0.2 | 30.0 | 54.2 | 60.7 |
| 12 | " | 0.77 | 0.08 | Ref. Ex. 9 | H | 0.2 | 28.8 | 54.1 | 61.0 |
| 13 | " | 0.77 | 0.08 | Ref. Ex. 9 | Na | 0.2 | 27.4 | 53.9 | 61.8 |
| 14 | Tatung | 0.52 | 0.02 | Ref. Ex. 1 | H | 0.2 | 30.1 | 54.3 | 60.7 |

TABLE 2-continued

| | Coal[2] | | | | | | Stability | | |
|---|---|---|---|---|---|---|---|---|---|
| | Coal | [H]/[C] | [O]/[C] | Stabilizer[3] | counter ion | Amount[4] (wt. %) | top layer | middle layer | bottom layer |
| 15 | Yallourn | 0.85 | 0.30 | Ref. Ex. 1 | H | 0.2 | 27.4 | 53.6 | 62.3 |

[1]Stabilizers in Comparative Examples 1–10 and coals in Comparative Examples 11–15 are outside the scope of the present invention.
[2]Warkworth and Yallourn coals used in COM preparation are produced in Australia and Tatung coal is produced in China.
[3]Refer to Referential Examples in Table 1.
[4]Weight percent based on COM The embodiments of the invention in which an exclusive privelege or property is claimed are defined as follows:

1. A mixed fuel composition which comprises (a) a fuel oil, (b) a coal powder having an [H]/[C] ratio according to the coalification band method in the range of 0.4–0.75 and an [O]/[C] ratio in the range of 0.09–0.18 and (c) a partially amidated copolymer obtained by reacting a copolymer of a polymerizable, unsaturated hydrocarbon and maleic anhydride with an aliphatic amine of 2–36 carbon atoms or a salt thereof as a stabilizer.

2. A mixed fuel composition as claimed in claim 1 wherein the polymerizable unsaturated hydrocarbon is an aliphatic olefin of 4–24 carbon atoms having a terminal double bond, styrene per se or styrene having an alkyl group of 1–6 carbon atoms as a substituent.

3. A mixed fuel composition as claimed in claim 1 wherein the partially amidated copolymer is obtained by using 0.6–1.2 moles of said aliphatic amine per mole of the acid anhydride corresponding to maleic anhydride moiety in the copolymer.

4. A mixed fuel composition as claimed in claim 1, wherein the partially amidated copolymer or salt thereof has a molecular weight of 1,000 to 50,000.

* * * * *

UNITED STATES PATENT AND TRADEMARK OFFICE

CERTIFICATE OF CORRECTION

PATENT NO. : 4 339 246

DATED : July 13, 1982

INVENTOR(S) : MIXED FUEL COMPOSITION

It is certified that error appears in the above—identified patent and that said Letters Patent is hereby corrected as shown below:

On the title page

Item [73] Assignees: change to read as follows:

---Kao Soap Co., Ltd., Lion Corporation, and Nippon Oil and Fats Co., Ltd., all of Tokyo, Japan---.

Signed and Sealed this

*Twelfth* Day of *October 1982*

[SEAL]

*Attest:*

GERALD J. MOSSINGHOFF

*Attesting Officer*

*Commissioner of Patents and Trademarks*